US007690517B2

(12) United States Patent
Purushothaman et al.

(10) Patent No.: US 7,690,517 B2
(45) Date of Patent: Apr. 6, 2010

(54) WASHING ACCESSORIES FOR SUPPORTING AN ARTICLE

(75) Inventors: Balaji Purushothaman, Augusta, GA (US); John C. Bragg, Goldsboro, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 1055 days.

(21) Appl. No.: 11/194,408

(22) Filed: Aug. 1, 2005

(65) Prior Publication Data

US 2006/0113260 A1 Jun. 1, 2006

Related U.S. Application Data

(60) Provisional application No. 60/632,103, filed on Dec. 1, 2004.

(51) Int. Cl.
*A47G 19/00* (2006.01)

(52) U.S. Cl. ..... 211/41.8

(58) Field of Classification Search ..... 211/41.5, 211/41.6, 41.8, 41.9, 10, 126.7, 126.12, 126.1, 211/126.2; 206/515, 518, 519, 557, 561, 206/564; D32/2, 3, 58, 59, 55
See application file for complete search history.

(56) References Cited

U.S. PATENT DOCUMENTS

| | | | | | |
|---|---|---|---|---|---|
| 990,454 | A * | 4/1911 | Peters | 211/41.5 |
| 3,025,967 | A * | 3/1962 | Christophersen | 211/41.5 |
| 3,269,548 | A * | 8/1966 | Geiger et al. | 211/41.8 |
| 3,752,322 | A * | 8/1973 | Fiocca et al. | 211/41.8 |
| 4,046,261 | A * | 9/1977 | Yake | 211/41.8 |
| 4,498,594 | A | 2/1985 | Elder | |
| 4,830,200 | A | 5/1989 | Zambano et al. | |
| 5,158,185 | A * | 10/1992 | Michael et al. | 211/41.8 |
| 5,332,105 | A * | 7/1994 | Stanfield | 211/41.4 |
| 5,344,029 | A * | 9/1994 | Oghia et al. | 211/41.8 |
| 5,351,837 | A * | 10/1994 | Smith | 211/41.8 |
| 5,431,294 | A | 7/1995 | Stottmann et al. | |
| 5,601,195 | A * | 2/1997 | Finola et al. | 211/41.8 |
| 5,840,035 | A * | 11/1998 | Heusmann et al. | 600/477 |
| 6,109,455 | A | 8/2000 | Schroeder | |
| 6,364,130 | B2 * | 4/2002 | Wright | 211/41.3 |
| 6,502,704 | B2 * | 1/2003 | Martorella et al. | 211/41.6 |
| 6,546,942 | B2 | 4/2003 | Smith et al. | |
| 6,571,965 | B1 * | 6/2003 | Beck et al. | 211/41.8 |
| 6,729,472 | B2 * | 5/2004 | Stucke et al. | 206/515 |
| 6,848,585 | B2 * | 2/2005 | VanLandingham | 211/41.9 |
| 7,168,578 | B2 * | 1/2007 | Mersch et al. | 211/41.8 |
| 7,228,975 | B2 * | 6/2007 | Yang et al. | 211/41.4 |
| 2002/0139809 | A1 | 10/2002 | Barry et al. | |
| 2003/0089672 | A1 * | 5/2003 | VanLandingham | 211/41.8 |
| 2004/0079713 | A1 | 4/2004 | Wendt et al. | |
| 2005/0241686 | A1 * | 11/2005 | Woo | 134/135 |
| 2006/0108298 | A1 * | 5/2006 | Kim | 211/41.8 |
| 2006/0237379 | A1 * | 10/2006 | Yang et al. | 211/41.4 |
| 2006/0254992 | A1 * | 11/2006 | Lim | 211/41.9 |

* cited by examiner

*Primary Examiner*—Jennifer E. Novosad
(74) *Attorney, Agent, or Firm*—Pearne & Gordon LLP

(57) ABSTRACT

A washing accessory is provided for supporting an article. The washing accessory includes a basket and can include an article positioning device adapted to be at least partially located within the reception area of the basket. If provided, the article positioning device comprises a first positioning element adapted to be removably attached with respect to the basket. The washing accessory can also comprise an optional cantilever support structure for supporting the washing accessory relative to a dishwasher rack.

20 Claims, 6 Drawing Sheets

WASHING ACCESSORIES FOR SUPPORTING AN ARTICLE

CROSS-REFERENCE TO RELATED APPLICATION

The present invention claims the benefit of U.S. Provisional Application No. 60/632,103 filed Dec. 1, 2004, the entire disclosure which is herein incorporated by reference.

FIELD OF THE INVENTION

The present invention relates to washing accessories and more particularly to washing accessories for a dishwasher rack.

BACKGROUND OF THE INVENTION

Conventional dishwashers typically include dishwasher racks adapted to support articles during a dishwashing cycle. For example, conventional racks may support pots, pans, plates, bowls, utensils, glassware, drinking vessels (e.g., cups, mugs, glasses, stemware) or other kitchenware. Dishwasher racks are known to include a basket mounted to the dishwasher rack to provide alternative support for articles, such as utensils, with respect to the dishwasher rack. There is a continuing need for baskets that can be effectively mounted to the dishwasher rack. In addition, there is a need for baskets that can safely orient one or more articles before, during and/or after the dishwashing cycle.

SUMMARY OF THE INVENTION

Accordingly, it is an aspect of the present invention to obviate problems and shortcomings of conventional article holders.

In accordance with one aspect, a washing accessory for supporting an article is provided. The washing accessory includes a basket with a length and an article reception area. The washing accessory further includes an article positioning device adapted to be at least partially located within the reception area of the basket. The article positioning device comprises a first positioning element including an attachment device adapted to removably attach the first positioning element with respect to the basket. The first positioning element defines a through slot extending through a first side and a second side of the first positioning element. The through slot includes an open top adapted to receive a portion of an article such that the article extends through the through slot substantially along the length of the basket.

In accordance with another aspect, a washing accessory for supporting an article is provided. The washing accessory includes a basket with a first rib including a first engagement surface, a second rib including a second engagement surface, and a reception area. The first rib is offset from the second rib and the first and second engagement surfaces face generally away from one another. The washing accessory further includes an article positioning device adapted to be at least partially located within the reception area of the basket to position an article with respect to the basket. The article positioning device comprises a first positioning element with an attachment device adapted to removably attach the first positioning element with respect to the basket. The attachment device includes a first tab and a second tab defining outer boundaries of an attachment area. The attachment device is adapted to removably attach the first positioning element with respect to the basket by straddling the first and second ribs such that the attachment area receives the first and second ribs with the first tab positioned adjacent the first engagement surface and the second tab positioned adjacent the second engagement surface.

In accordance with still another aspect, a washing accessory is provided for a dishwasher rack having an outer perimeter that bounds a storage volume. The washing accessory comprises a basket including a cantilever support structure comprising an engagement member adapted to engage an outer perimeter of a dishwasher rack. The cantilever support structure further comprises a fulcrum with a protrusion extending away from a side of the washing accessory.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF EXAMPLE EMBODIMENTS

Figure 1:
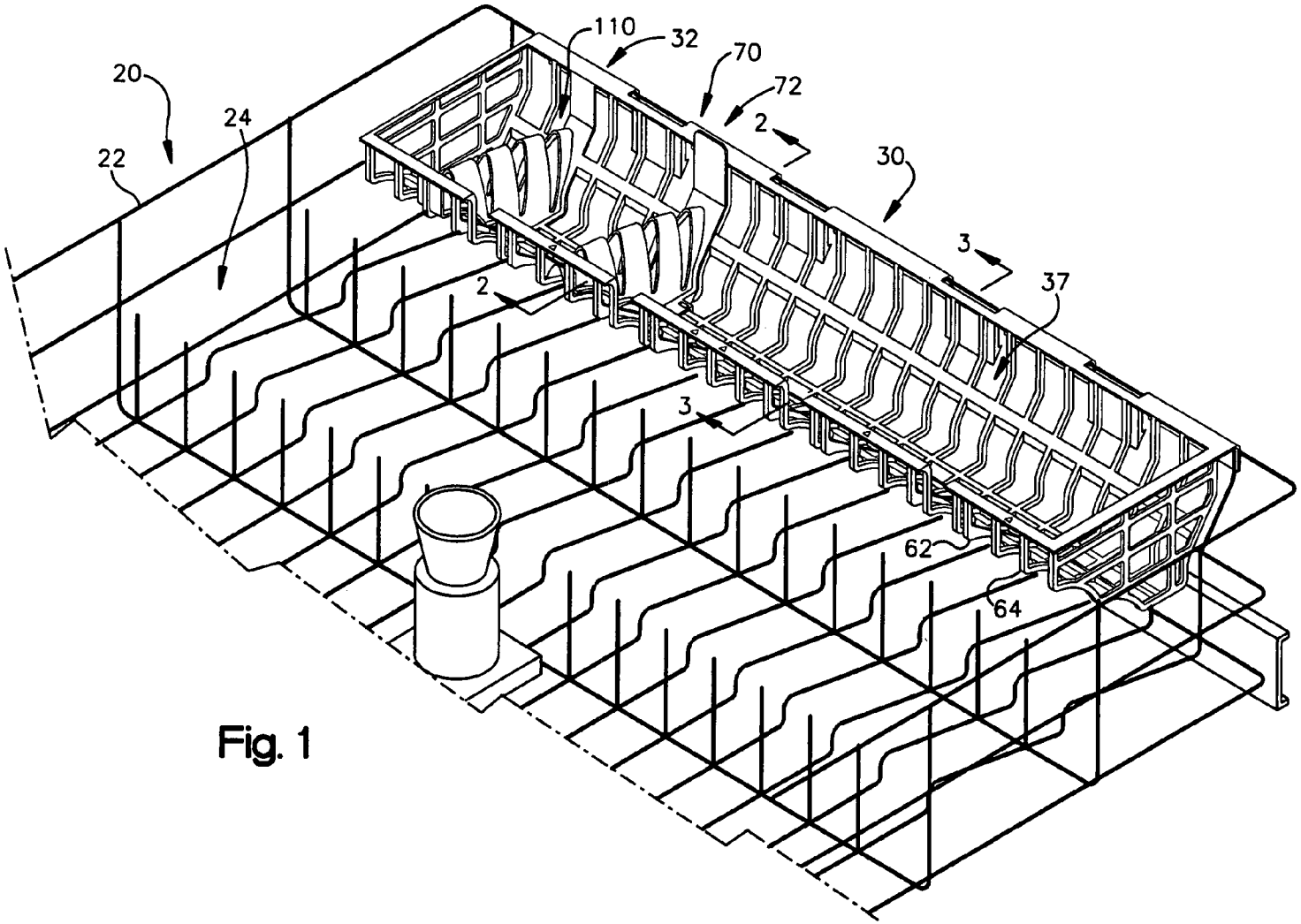
FIG. 1 depicts a perspective view of portions of a dishwasher rack and a washing accessory in accordance with an exemplary embodiment of the present invention.

Certain terminology is used herein for convenience only and is not to be taken as a limitation on the present invention. Further, in the drawings, the same reference numerals are employed for designating the same elements.

FIG. 1 depicts a washing accessory 30 for supporting an article. Washing accessories in accordance with the present invention may be used to support a wide range of articles. For example, washing accessories may be designed to support pots, pans, plates, bowls, utensils, glassware, drinking vessels (e.g., cups, mugs, glasses, stemware) or other kitchenware or the like. Exemplary utensils may comprise elongated utensils such as silverware, cooking utensils, knives, or the like. Moreover, washing accessories herein may be used in a wide variety of ways before, during and/or after the dishwashing cycle.

Exemplary embodiments of the present invention may provide a washing accessory for use within or outside of the dishwashing environment. For example, washing accessories herein may be used to support articles within the dishwasher before or during the dishwashing cycle. Still further, washing accessories herein may be used outside of a dishwashing machine environment. For example, washing accessories herein may be used as a drying rack on a support surface such as a kitchen counter, or the like.

Figure 2:
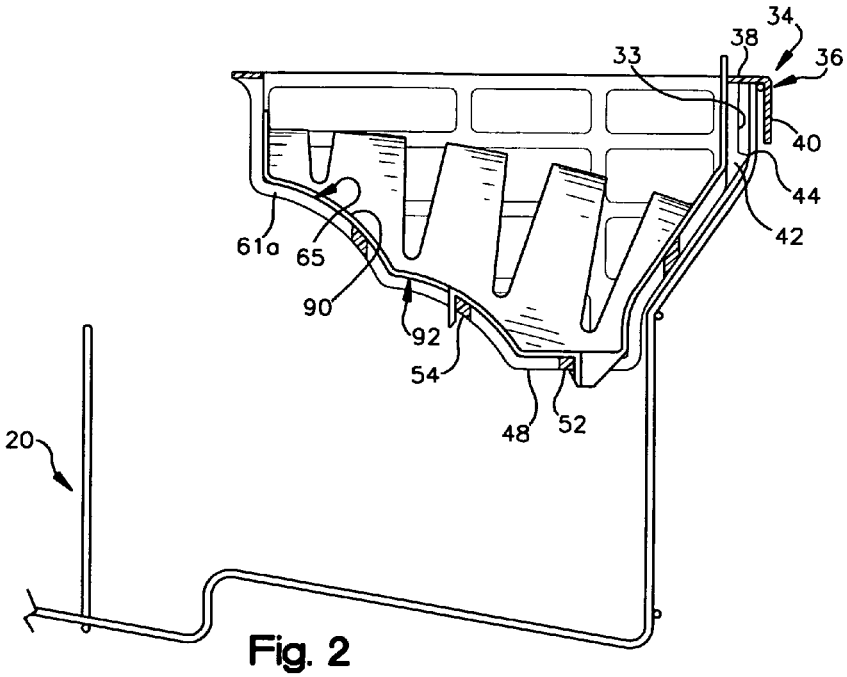
FIG. 2 is a sectional view of portions of the dishwasher rack and washing accessory along line 2-2 of FIG. 1.
Figure 3:
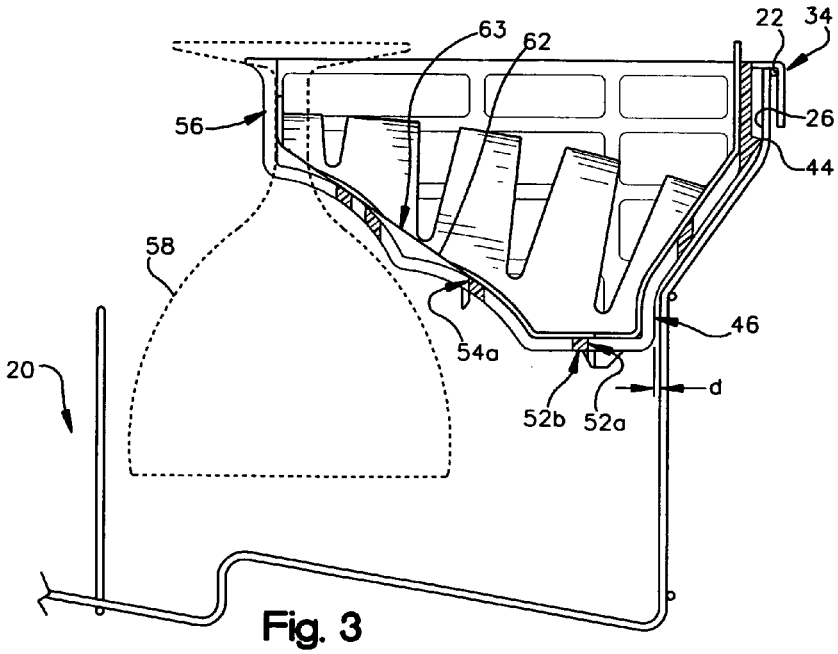
FIG. 3 is a sectional view of portions of the dishwasher rack and washing accessory along line 3-3 of FIG. 1.

It is further contemplated that washing accessories might have provisions to facilitate placement and/or mounting within the dishwashing cavity of a dishwashing machine. For instance, exemplary washing accessories may be designed for location at least partially within or outside of a dishwashing rack. In such embodiments, the washing accessory may be used in combination with a wide range of dishwasher racks. FIGS. 1-3 depict one example of a dishwasher rack 20 that may be used in combination with washing accessories incorporating one or more aspects of the present invention. As shown, the dishwasher rack 20 can include an outer perimeter 22 that bounds a storage volume 24 adapted to support articles therein. For example, the dishwasher rack may support pots, pans, plates, bowls, utensils, glassware, drinking vessels (e.g., cups, mugs, glasses, stemware) or other kitchenware, or the like, at least partially within the storage volume 24 of the dishwasher rack 20.

Washing accessories may include structure adapted to fasten or support exemplary washing accessories with respect to a dishwashing rack. For example, washing accessories may have one or more clips of other fasteners designed to releasably attach the washing accessory to a dishwashing rack. In one example, one or more clips may be provided that are adapted to snappingly receive a wire structure of a dishwasher rack. In further examples, washing accessories may be hung with respect to the dishwashing rack by way of one or more hooks, channels, snapping structures or the like. As shown in the illustrated example, the structure adapted to fasten or support, if provided, may comprise a cantilever support structure 34. As shown in FIGS. 2-3, the cantilever support structure 34 comprises an engagement member 36 adapted to engage the outer perimeter 22 of the dishwasher rack 20. The illustrated engagement member 36 comprises an L-shaped member although a wide variety of alternative structures may be used in accordance with aspects of the present invention. As shown, the L-shaped member can include an outward extension 38 and a downward extension 40. The outward extension 38 and downward extension 40 are connected together at a corner area adapted to provide a seat for the outer perimeter 22 as shown in FIGS. 2 and 3. The corner between the outward extension 38 and the downward extension 40 can comprise various alternative angles. For example, the outward and downward extension can meet to define a corner area with an angle of approximately 90 degrees as shown in FIGS. 2 and 3. In further examples, the angle of the corner may be less than or greater than 90 degrees. Forming the engagement member 36 as an L-shaped member with such a corner area can simplify the process of mounting and dismounting of the washing accessory 30 from the dishwasher rack 20.

If provided, the cantilever support structure 34 can further comprise a fulcrum 44 adapted to engage a side 26 of the dishwasher rack 20. The fulcrum 44 may include a protrusion 42 extending away from a side 33 of the washing accessory 30. The protrusion 42 in combination with the engagement member 36 can cooperate with the dishwasher rack to facilitate mounting and/or maintenance of a predetermined orientation between the washing accessory 30 and the dishwasher rack 20. For example, as shown in FIGS. 2-3, the fulcrum 44 engages the side 26 of the dishwasher rack 20 to act as a pivot point. The weight of the washing accessory 30 tends to pivot the washing accessory 30, in a counterclockwise direction as shown in FIGS. 2 and 3, about the fulcrum 44. The outer perimeter 22 of the dishwasher rack 20 engages the engagement member 36 to counter the weight of the washing accessory wherein a predetermined distance "d" may be maintained between the side 26 of the dishwasher rack 20 and an outer surface 46 of the washing accessory 30. For example, as shown, the tendency of the washing accessory 30 to rotate about the fulcrum 44 can cause the outer perimeter 22 to be seated within the corner area of the engagement member 36 as shown in FIGS. 2 and 3. Although not shown, the protrusion may be adjustable such that the distance "d" may be selected based on the preferences of the user. Moreover, an adjustable protrusion may permit the washing accessory to be used with dishwasher racks having different sizes or configurations.

If provided, the fulcrum 44 may be offset from an upper portion of the engagement member 36. For example, in the illustrated embodiment, the fulcrum 44 is offset from the outward extension 38 that comprises the upper portion of the engagement member. Although not shown, it is contemplated that the fulcrum may be positioned at a bottom portion 48 or below the bottom portion 48 of the washing accessory 30. Alternatively, as shown, the fulcrum 44 can be located at an elevation between the bottom portion 48 of the washing accessory 30 and the upper portion of the engagement member 36. Providing the fulcrum at the elevation between the bottom portion 48 of the washing accessory 48 and the upper portion of the engagement member (e.g., the outward extension 38) can allow the weight of the washing accessory 30 to appropriately seat the outer perimeter 22 with respect to the engagement member 36.

Washing accessories in accordance with further aspects of the present invention may further include features to accommodate articles. For example, as shown, the exemplary washing accessory can comprise a basket 32 having a length "L" and an article reception area 37 adapted to at least partially receive articles (e.g., kitchenware). As shown, the exemplary washing accessory 30 can include an article positioning device 70 adapted to be at least partially located within the article reception area 37 of the basket 32.

The article positioning device 70, if provided, can have one or more positioning elements adapted to support one or more articles to extend along the length "L" of the basket 32. In one example, the article positioning device 70 comprises a single first positioning element 72 adapted to independently support one or more articles to extend along the length "L" of the basket 32. As shown, the article positioning device 70 can also comprise a second positioning element 110 offset from the first positioning element 72. The first and second positioning elements 72, 110 can cooperate to support certain articles such that the article extends along the length "L" of the basket 32. In further examples, three or more positioning elements are provided that are adapted to cooperate to support one more articles along the basket 32.

If two or more article positioning elements are provided, one or all of the positioning elements may be integral with the basket. Maximizing the number of positioning elements that are integral with the basket may minimize costs of fabricating the washing accessory and reduce the probability of parts being lost by the consumer. However, maximizing the number of positioning elements that are adapted to be removably attached to the basket increases the versatility of the basket to permit accommodation of a wide range of articles having different lengths and sizes. Providing one or more positioning elements that are integral with the basket and also providing one or more positioning elements that are adapted to be removably attached to the basket can provide a desirable balance between reducing costs and increasing versatility of the washing accessory. In the illustrated embodiment, for example, the article positioning device 70 includes a first positioning element 72 that can be removably attached with respect to the basket and a second positioning element 110 that is integral with the basket 32. In such an embodiment, the first positioning element 72 may be removed from the basket wherein articles may be independently supported by the second positioning element 110. Still further, as shown, the integral second positioning element 110 may be located adjacent an end or central portion of the basket 32. Locating an integral positioning element adjacent an end of the basket can maximize the unobstructed area available to support articles without using the positioning device. Furthermore, locating an integral positioning element at a central portion of the basket can also act as a partition for articles supported without the use of the positioning device.

The removable first positioning element 72 may also be provided at an offset location from the integral second positioning element 110. Providing support at two locations can predetermine the orientation and location of supported articles along the length "L" of the basket 32. Moreover, the first positioning element 72 may be mounted to the basket at different distances from the second positioning element 110 to accommodate one or more articles having different lengths.

Figure 4:
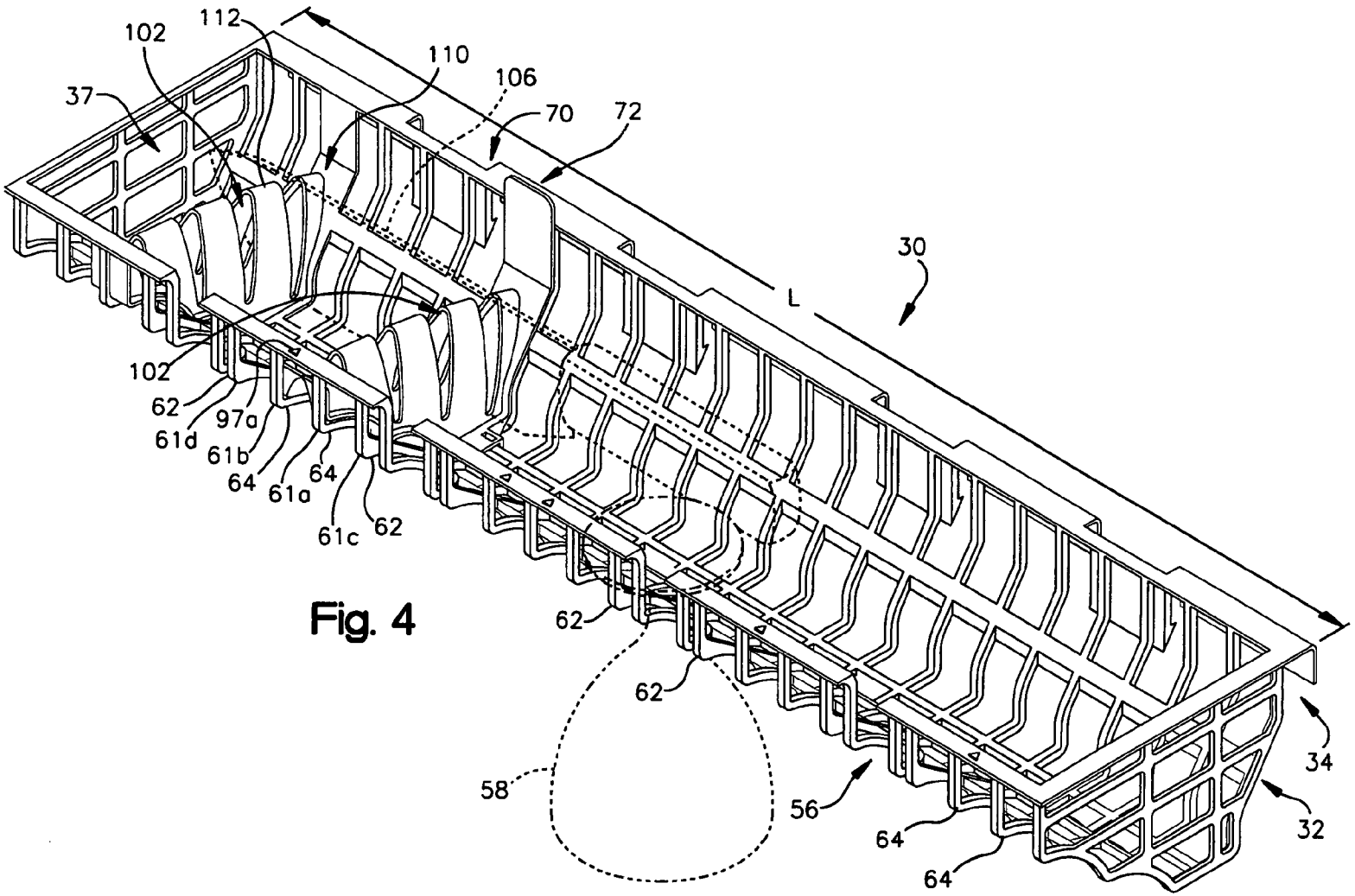
FIG. 4 is a perspective view of the washing accessory of FIG. 1.
Figure 9:
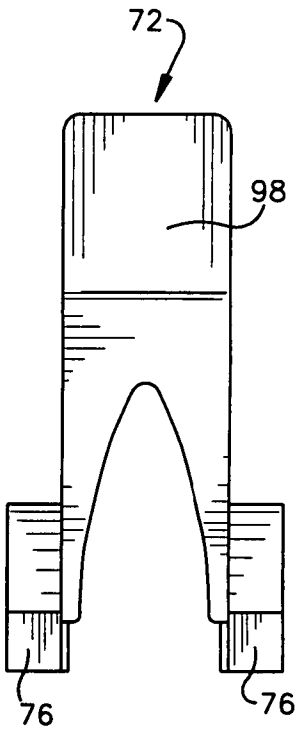
FIG. 9 is a rear elevational view of the first positioning element of FIG. 6.
Figure 8:
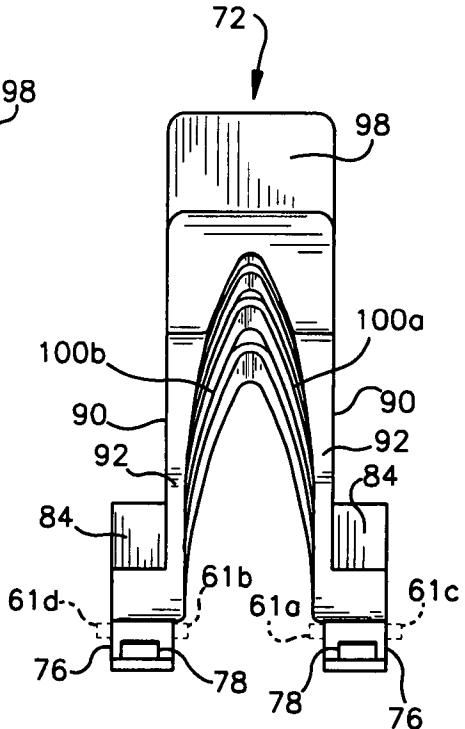
FIG. 8 is a front elevational view of the first positioning element of FIG. 6.
Figure 7:
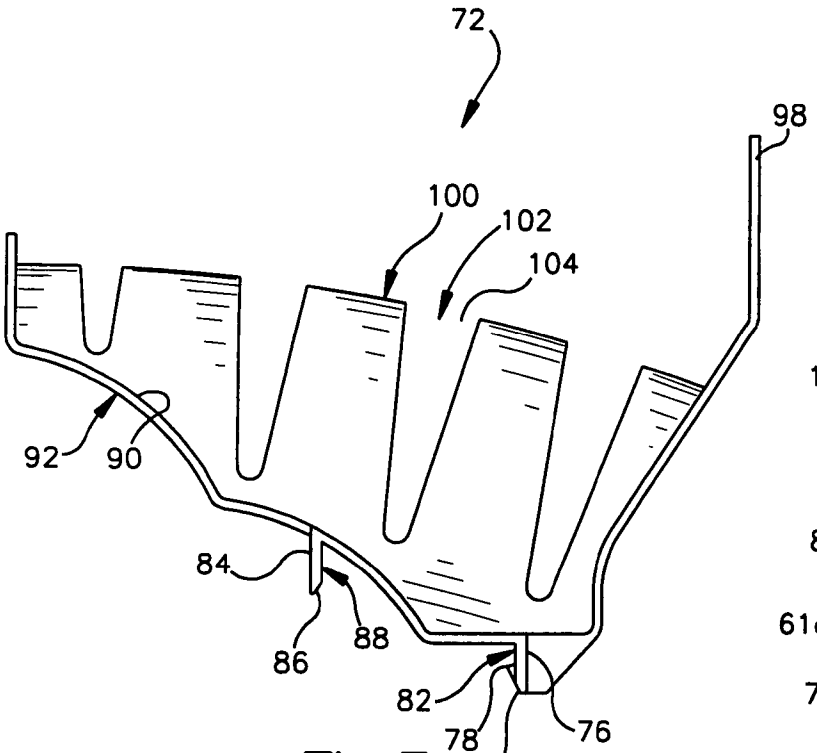
FIG. 7 is a side elevational view of the first positioning element of FIG. 6.

In accordance with exemplary washing accessories, at least one positioning element may have structural arrangements to facilitate support of the article. For example, if two or more positioning elements are provided, at least one of the positioning elements may have a structural arrangement to facilitate support of the article while the first and second positioning elements cooperate to support the article. Exemplary structural arrangements may receive, trap, grasp, clip, support, fasten and/or otherwise position the article with respect to the basket 32. Such structural arrangements may be mixed and/or matched with the one or more positioning elements. For example, one of the positioning elements may have one or more similar or different structural arrangements adapted to support different article sizes or types. Although not necessary, if a plurality of positioning elements are provided, each positioning element may be provided with similar or different structural arrangements adapted to cooperate to support various types and sizes of articles. In the illustrated embodiment, for instance, the first positioning element 72 includes an engagement structure 100 comprising a plurality of through slots 102 having different sizes that are adapted to accommodate various types of articles. As shown in FIGS. 7-9, for example, each through slot 102 extends through a first side 100*a* and a second side 100*b* of the first positioning element 72. The through slot 102 includes an open top 104 adapted to receive a portion of an article such that the article extends through the through slot 102 substantially along the length "L" of the basket 32. Each through slot 102 can have a wide variety of shapes such as a substantially U-shape, a substantially V-shape, a substantially hemispherical shape, a shape with a rectilinear and/or smooth surface shape, and/or other shapes adapted to receive a portion of an article. The illustrated slots 102 include a generally V-shaped slot. As shown, the V-shaped slot may diverge in a direction toward the open top 104 of the slot 102. Such a V-shaped slot may tend to arrest certain movements of the peripheral edges of an article supported by the positioning elements. For example, the first positioning element 72 and second positioning element 110 have similar pairs of V-shaped through slots 102 that diverge in a direction toward the open top 104 of each slot 102. Such through slots 102 may accommodate a wide range of articles. For instance, as shown in FIG. 4, such through slots 102 may cooperate to support a knife 106 (shown in broken lines). As shown, the blade is received by a pair of V-shaped slots from the first and second positioning element such that the knife 106 substantially extends along the length "L" of the basket 32. Moreover, as shown, the knife 106 may be inserted with the blade nested in the lower area of the through slots 102. Therefore, the knife 106 may be supported with the blade pointing down and away to reduce exposure of a user to dangerous cutting edges of the knife. Moreover, such V-shaped slots can somewhat immobilize the blade of the knife 106 to prevent dulling of the knife edge and/or inadvertent cutting by the knife during the dishwashing process.

The article positioning device 70, if provided, can include an attachment device adapted to removably attach a positioning element with respect to the basket 32. The attachment device can comprise a wide variety of structural arrangements adapted to removably attach the positioning element with respect to the basket 32 depending upon the structural characteristics of the basket 32. In the illustrated example, a lattice of offset longitudinal ribs 50 and offset lateral ribs 60 form a basket 32 with interstitial open areas adapted to permit liquid to permeate the walls of the basket while supporting articles within the basket. The tabs of the attachment device may cooperate with a pair of lateral and/or longitudinal ribs while incorporating concepts of the present invention. Moreover, the tabs of the attachment device may cooperate with a pair or ribs that are adjacent to one another or a pair of ribs that have further ribs disposed between the pair of ribs. By way of example, the longitudinal ribs 50 can comprise a first longitudinal rib 52 with a first engagement surface 52*a* and a second longitudinal rib 54 with a second engagement surface 54*a*. As shown in FIG. 3, the first and second engagement surfaces 52*a*, 54*a* are substantially parallel and face generally away from one another in opposite directions. In further examples, the surfaces may not be parallel with respect to one another while still facing generally away from one another. For instance, the surfaces may face upwardly and generally away from one another. Such an arrangement may present a ramped surface arrangement to facilitate attachment of the first positioning element with respect to the basket.

As shown, the longitudinal ribs 50 can extend such that they are generally offset and parallel with respect to one another and extend along the length "L" of the basket 32. Although not shown, the longitudinal ribs might be offset without being parallel with respect to one another. For instance, the longitudinal ribs might intersect at one or more areas while remaining offset from one another in other areas. However, providing ribs that are parallel with respect to one another may increase the number of attachment locations between the first positioning element and the basket.

Figure 6:
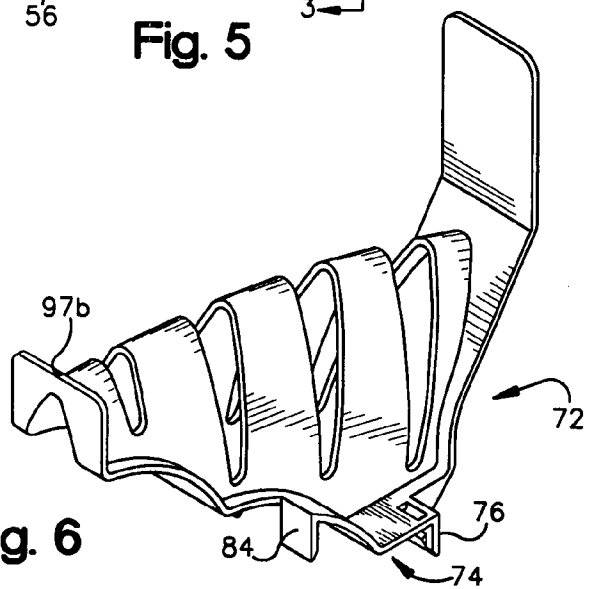
FIG. 6 is a perspective view of the first positioning element of the washing accessory of FIG. 4.

As shown in FIGS. 6-9, the first positioning element 72 can include an attachment device adapted to straddle two or more ribs of the basket. In the illustrated embodiment, the attachment device includes a first tab 76 and a second tab 84, opposed from the first tab, that are adapted to be respectively positioned adjacent engagement surfaces 52*a*, 54*a* of the first and second longitudinal ribs 52, 54. Although a single first and second tab may be incorporated, the illustrated embodiment depicts a pair of first tabs and a pair of second tabs opposed from the first tabs. Although not necessary, the pair of first tabs may be constructed identical to one another and the pair of second tabs may be constructed identical to one another. For example, FIG. 6 depicts a first tab 76 of a first pair of identical tabs and a second tab 84 of a second pair of identical tabs. The first and second tabs 76, 84 define outer boundaries of an attachment area 74 adapted to receive the first and second longitudinal ribs 52, 54. As shown in FIG. 7, the first tab 76 can comprise a planar surface 82 defining a first outer boundary of the attachment area 74. Likewise, the second tab 84 can comprise a planar surface 88 defining a second outer boundary of the attachment area 74. The first tab 76 can also comprise an optional beveled surface 80 and/or the second tab 84 can comprise an optional beveled surface 86. The beveled surfaces, if provided, can facilitate the process of removably attaching the first positioning element 72 with respect to the basket 32. In further examples, one or more of the tabs can be provided with a locking protrusion for facilitating a locking orientation between the first positioning element and the basket. For example, as shown in FIG. 7, the first tab 76 may be provided with a locking protrusion 78. In certain examples of the present invention, locking protrusions may be provided on both the first and second tab of the attachment device. Providing locking protrusions on both tabs may strengthen the locking connection between the first positioning element and the basket. In the illustrated example, only one of the tabs (e.g., the first tab 76) includes the locking protrusion while the other tab (e.g., the second tab 84) is provided without a locking protrusion. Providing only one of the first and second tabs with the locking protrusion may simplify a process of releasing the first positioning element from the basket. The first positioning element 72 can also be provided with an optional lever 98 adapted to selectively move the locking protrusion 78 to unlatch the first positioning element 72 from the basket 32. Although a single lever 98 is illustrated, it is contemplated that two or more levers may be provided. For example, in embodiments where both tabs include a locking protrusion, a lever may be provided for each locking protrusion.

Figure 10:
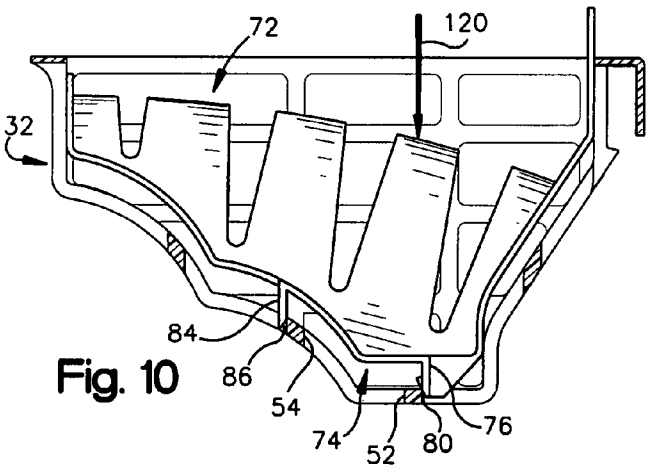
FIG. 10 is a sectional view illustrating the process of attaching the first positioning element to the basket.
Figure 11:
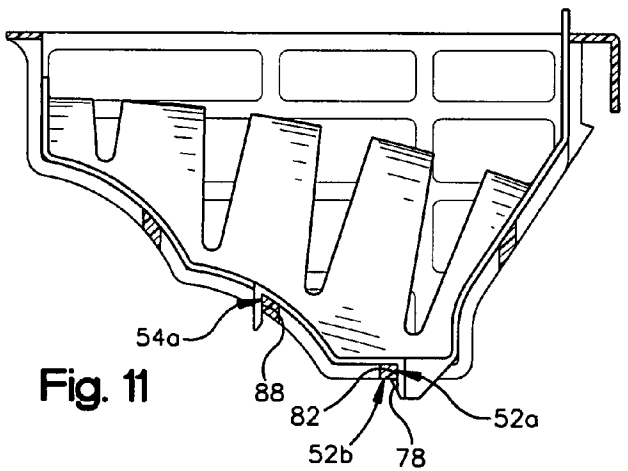
FIG. 11 is a sectional view of the washing accessory after the first positioning element is attached to the basket.

A process of releasably attaching and removing the first positioning element 72 is illustrated in FIGS. 10-13. As shown in FIG. 10, the first positioning element 72 is first positioned with respect to the basket 32 at an attachment zone. Then a downward force is applied, for example, by pressing down along arrow 120 in FIG. 10. Upon application of force along arrow 120, the beveled surfaces 80, 86 of the first and second tab 76, 84, respectively, ramp over first and second longitudinal ribs 52, 54 of the basket 32. Continued application of force along arrow 120 permits the attachment device to removably attach the first positioning element 72 with respect to the basket 32. Indeed, as shown in FIG. 11, the attachment device straddles the first and second longitudinal ribs 52, 54 with the attachment area 74 receiving the first and second longitudinal ribs 52, 54. The attachment device is positioned such that the first tab 76 is positioned adjacent the first engagement surface 52*a* of the first longitudinal rib 52 while the second tab 84 is positioned adjacent the second engagement surface 54*a* of the second longitudinal rib 54. In the illustrated example, the substantially planar surface 82 of the first tab 76 engages the substantially planar surface of the first engagement surface 52*a* and the substantially planar surface 88 of the second tab 84 engages the substantially planar surface of the second engagement surface 54*a*. The locking protrusion 78 also selectively extends along a lower surface 52*b* of the first rib 52 to releasably lock the first positioning element 72 to the basket 32.

Figure 12:
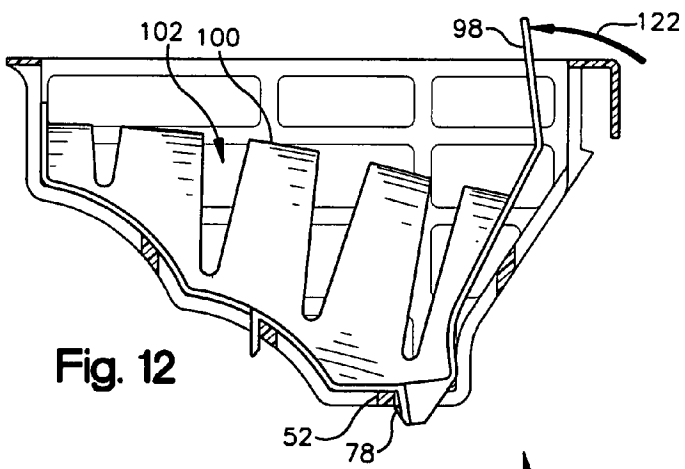
FIG. 12 is a sectional view illustrating the process of unlatching the first positioning element from the basket.
Figure 13:
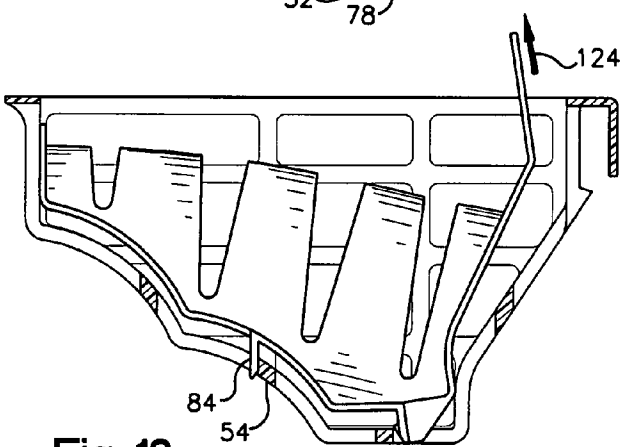
FIG. 13 is a sectional view illustrating the process of pulling the first positioning out of engagement with the basket.

FIGS. 12 and 13 depict an exemplary process of selectively removing an attached first positioning element 72 from the basket 32. As shown in FIG. 12, a force is applied to the lever 98 along direction 122. The arrangement of through slots 102 of the first positioning element cause the force along direction 122 to compress an upper portion of the engagement structure 100 greater than the lower portion of the engagement structure 100. As a result, the locking protrusion 78 moves away from the lower surface 52*b* of the first rib 52 to unlatch the first positioning element 72 from the basket 32. Once unlatched, the second tab 84 is free to travel with respect to the second longitudinal rib 54. As shown in FIG. 13, the lever 98 may then be pulled along arrow 124 to completely disengage the first positioning element 72 from the basket 32.

A single lever design can simplify unlatching and removal of the first positioning element from the basket. For instance, in the illustrated embodiment, only a single lever 98 is necessary to unlatch locking protrusions 78 associated with the first tabs 76. Disengagement of the first positioning element 72 from the basket 32 is therefore simplified since only a single lever needs to be manipulated to unlatch and disengage the first positioning element 72 from the basket 30. Although not shown, the first tab 76 and second tab 84 can each include locking protrusions. In such an embodiment, a second lever might be provided wherein first and second levers are incorporated in at the front and rear of the first positioning element. The first positioning element can then be unlatched from the basket by pinching the first and second levers toward each other to simultaneously move the locking protrusions associated with the first and second tabs.

The first positioning element 72, if provided, can be adapted for removable attachment with respect to the basket 32 at one of a plurality of preselected attachment zones located along the length "L" of the basket 32. For example, the first positioning element can include features that cooperate with features of the basket to allow attachment at the attachment zones. In exemplary embodiments, the first positioning element can have a shape that matches a shape of the basket at each of the plurality of attachment zones. For example, as shown in FIGS. 7 and 8, the first positioning element 72 includes a pair of engagement rims 90 that each include a lower surface 92. As shown in FIG. 2, the lower surface 92 of each engagement rim 90 conforms to the shape of corresponding upper surfaces 65 of conforming ribs 64 including a first lateral rib 61*a* and a second lateral rib 61*b* at the attachment zones. As best shown in FIG. 8, one of the first tabs 76 and one of the aligned second tabs 84 (not shown in FIG. 8) are adapted to extend between the first lateral rib 61*a* and a third lateral rib 61*c*. Likewise, the other of the first tabs 76 and the other of the second tabs 84 (not shown in FIG. 8) are adapted to extend between the second lateral rib 61*b* and a fourth lateral rib 61*d*.

If provided with a first positioning element, the washing accessory can be also be adapted to inhibit, such as prevent, attachment of the first positioning element at one or more nonattachment zones located along the length "L" of the basket 32. For example, the first positioning element can include features that do not cooperate with features of the basket at the nonattachment zones. In exemplary embodiments, the first positioning element can have a shape that does not match a shape of the basket at the nonattachment zones. For example, as shown in FIGS. 3, 7 and 8, the lower surface 92 of each engagement rim 90 does not conform to the shape of corresponding upper surfaces 63 of a lockout lateral rib 62 at the nonattachment zones. Accordingly, it will be appreciated that the basket can include lateral ribs 60 comprising conforming ribs 64 or lockout ribs 62 adapted to control where the first positioning element 72 is attached relative to the basket 32.

Providing attachment zones and nonattachment zones may be beneficial for a wide variety of reasons. In one example, the washing accessory may be designed with nonattachment zones that correspond to positions that would otherwise interfere with certain functionalities of the dishwasher and/or the washing accessory. For instance, as shown in FIGS. 3 and 4, exemplary baskets 32 of the present invention may include one or more stemware notches 56 adapted to support stemware 58 in an inverted orientation. In such instances, the washing accessory may be provided with a nonattachment zone corresponding to one or more of the stemware notches to inhibit, such as prevent, attachment of the first positioning element 72 with respect to the basket 32 when the first positioning element 72 is aligned with the stemware notch 56. As shown in FIG. 4, for example, each stemware notch 56 includes a lockout rib 62 disposed on each side of the notch 56 to create a nonattachment zone corresponding to each stemware notch 56. Accordingly, the nonattachment zones inhibit, such as prevent, attachment of the first positioning element 72 at an aligned position with respect to the stemware notch 56 that would otherwise obstruct the stemware notch 56 from being used to support stemware 58.

Figure 5:
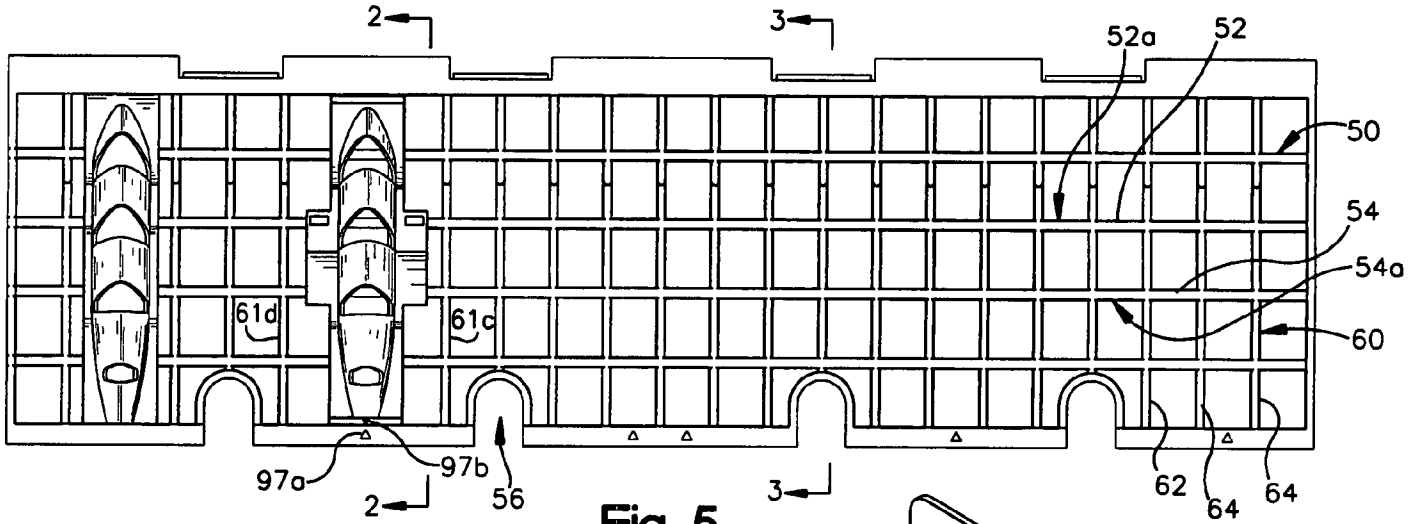
FIG. 5 is a top plan view of the washing accessory of FIG. 4.

If a nonattachment zone and one or more attachment zones are provided, the washing accessory can include means for indicating when the first positioning element 72 is located at one of the plurality of preselected attachment zones. In exemplary embodiments the basket 32 can include indicia and/or other features designed to indicate when the first positioning element is located at one of the plurality of preselected attachment zones. In further embodiments, the basket 32 and the first positioning element 72 can both include indicia and/or other features for indicating that the first positioning element 72 is located at one of the plurality of preselected attachment zones. As shown in FIGS. 4-6, the basket 32 may include a protrusion 97*a* in the shape of an arrow adapted to point to an attachment zone. Although not required, the first positioning element 72 can also include a corresponding protrusion 97*b*, comprising an arrow adapted to align with an arrow of the basket to indicate the attachment zone. Although the protrusions of the basket and first positioning element are shaped as arrows, further protrusions may include other shapes such as lines, circles or other shapes that can act to indicate an attachment zone. Moreover, although the features of the basket and the first positioning element comprise protrusions, it is contemplated that the features may comprise recesses within the structure to provide an appropriate indicating function. Moreover, a label or other indicia may be incorporated with the basket and/or first positioning element to provide an appropriate indicating function.

From the above description of the invention, those skilled in the art will perceive improvements, changes and modifications. Such improvements, changes and modifications within the skill of the art are intended to be covered by the appended claims.

What is claimed:

1. A washing accessory for supporting an article, the washing accessory comprising:

a basket including a length and an article reception area; and an article positioning device adapted to be at least partially located within the reception area of the basket, the article positioning device comprising a first positioning element including an attachment device adapted to removably and nonrotatably attach the first positioning element with respect to the basket, the first positioning element defining a through slot extending through a first side and a second side of the first positioning element, the through slot including an open top adapted to receive a portion of an article such that the article extends through the through slot substantially along the length of the basket, wherein the basket includes a first rib and a second rib, and the attachment device includes a first tab and a second tab, and at least the first tab includes a locking protrusion adapted to selectively engage the first rib of the basket to releasably latch the first positioning element to the basket.

2. The washing accessory of claim 1, wherein the first positioning element is adapted to be attached with respect to the basket at one of a plurality of preselected attachment zones located along the length of the basket.

3. The washing accessory of claim 2, wherein the washing accessory includes means for indicating when the first positioning element is located at one of the plurality of preselected attachment zones.

4. The washing accessory of claim 2, wherein the washing accessory is adapted to inhibit attachment of the first positioning element at one or more nonattachment zones located along the length of the basket.

5. The washing accessory of claim 4, wherein the first positioning element includes a surface having a shape that matches a shape of the basket at each of the plurality of attachment zones and does not match a shape of the basket at each of the one or more nonattachment zones.

6. The washing accessory of claim 1, wherein the basket further includes a stemware notch and the washing accessory is adapted to inhibit attachment of the first positioning element with respect to the basket when the first positioning element is aligned with the stemware notch.

7. The washing accessory of claim 1, wherein the through slot comprises a generally V-shaped slot that diverges in a direction toward the open top of the slot.

8. The washing accessory of claim 1, wherein the article positioning device further comprises a second positioning element attached to the basket and including an engagement structure adapted to cooperate with the through slot of the first positioning element to position an article with respect to the basket such that the article extends generally along the length of the basket.

9. The washing accessory of claim 8, wherein the second positioning element is integral with the basket.

10. The washing accessory of claim 1, wherein at least a portion of the first tab is positioned laterally with respect to the first rib and at least a portion of the second tab is positioned laterally with respect to the second rib.

11. The washing accessory of claim 10, wherein the locking protrusion of the first tab is adapted to selectively engage underneath the first rib of the basket to releasably latch the first positioning element to the basket.

12. A washing accessory for supporting an article, the washing accessory comprising:

a basket including a length and an article reception area;

an article positioning device adapted to be at least partially located within the reception area of the basket, the article positioning device comprising a first positioning element including an attachment device adapted to removably attach the first positioning element with respect to the basket, the first positioning element defining a through slot extending through a first side and a second side of the first positioning element, the through slot including an open top adapted to receive a portion of an article such that the article extends through the through slot substantially along the length of the basket;

wherein the basket includes a first rib with a first engagement surface and a second rib with a second engagement surface, wherein the first rib is offset from the second rib, and wherein the first and second engagement surfaces face generally away from one another, and wherein the attachment device of the first positioning element includes a first tab and a second tab defining outer boundaries of an attachment area, wherein the attachment device is adapted to removably attach the first positioning element with respect to the basket by straddling the first and second ribs such that the attachment area receives the first and second ribs with the first tab positioned adjacent the first engagement surface and the second tab positioned adjacent the second engagement surface.

13. The washing accessory of claim 12, wherein the first and second engagement surfaces each comprise a substantially planar surface, the first tab includes a substantially planar surface adapted to engage the substantially planar surface of the first engagement surface and the second tab includes a substantially planar surface adapted to engage the substantially planar surface of the second engagement surface.

14. The washing accessory of claim 12, wherein the first tab includes a locking protrusion adapted to selectively extend along another surface of the first rib to releasably lock the first positioning element to the basket.

15. The washing accessory of claim 14, wherein the second tab does not include a locking protrusion.

16. The washing accessory of claim 14, wherein the first positioning element includes a lever adapted to selectively move the locking protrusion with respect to the first rib to release the first positioning element from the basket.

17. The washing accessory of claim 12, wherein the first positioning element is adapted to be attached with respect to the basket at one of a plurality of preselected attachment zones located along the length of the basket.

18. The washing accessory of claim 17, wherein the washing accessory is adapted to inhibit attachment of the first positioning element at one or more nonattachment zones located along the length of the basket.

19. A washing accessory for supporting an article, the washing accessory comprising:

a basket including a length and an article reception area; and an article positioning device adapted to be at least partially located within the reception area of the basket, the article positioning device comprising a first positioning element including an attachment device adapted to removably and nonrotatably attach the first positioning element with respect to the basket, the first positioning element defining a through slot extending through a first side and a second side of the first positioning element, the through slot including an open top adapted to receive a portion of an article such that the article extends through the through slot substantially along the length of the basket, wherein the basket includes a cantilever support structure adapted to support the washing accessory with respect to an outer perimeter of a dishwasher rack, the cantilever support structure including an engagement member adapted to engage an outer perimeter of a dishwasher rack and a fulcrum comprising a protrusion extending away from a side of the washing accessory, wherein the protrusion is positioned at an elevation between a bottom portion of the washing accessory and an upper portion of the engagement member.

20. The washing accessory of claim 19, wherein the engagement member comprises an L-shaped member.

* * * * *